United States Patent [19]

Lopata et al.

[11] 4,116,022

[45] Sep. 26, 1978

[54] DEVICE FOR PRINTING ON WEBS OF TEXTILE MATERIAL

[75] Inventors: Karl Peter Lopata; Günter Schiffer, both of Krefeld, Fed. Rep. of Germany

[73] Assignee: Kleinewefers Industrie-Companie GmbH, Krefeld, Fed. Rep. of Germany

[21] Appl. No.: 718,620

[22] Filed: Aug. 30, 1976

[30] Foreign Application Priority Data

Sep. 1, 1975 [DE] Fed. Rep. of Germany ..... 2538795
Sep. 17, 1975 [DE] Fed. Rep. of Germany ..... 2541448

[51] Int. Cl.[2] ..... B41M 5/26

[52] U.S. Cl. ..... 68/5 D; 8/2.5 A; 34/116; 101/470

[58] Field of Search ..... 101/470; 8/2.5 A; 34/86, 116, 122, 155, 115; 68/5 C, 5 D

[56] References Cited

U.S. PATENT DOCUMENTS

| | | | |
|---|---|---|---|
| 1,615,210 | 1/1927 | Asten | 34/116 |
| 2,578,633 | 12/1951 | Mauffre | 34/155 |
| 2,711,032 | 6/1955 | Penley | 34/122 |
| 2,896,336 | 7/1959 | Shoumatoff | 34/86 |
| 3,750,306 | 8/1973 | Rodwin et al. | 34/115 |
| 3,768,280 | 10/1973 | Kannegiesser et al. | 101/470 |

FOREIGN PATENT DOCUMENTS

| | | | |
|---|---|---|---|
| 2,255,898 | 3/1974 | Fed. Rep. of Germany | 101/470 |

OTHER PUBLICATIONS

JSDC Dec. 1973; pp. 474–480; Possibilities of Vacuum Technology.

*Primary Examiner*—Clyde I. Goughenour
*Attorney, Agent, or Firm*—Walter Becker

[57] ABSTRACT

Apparatus for printing upon webs of textile material by sublimation of the dye of a web of printing foil covering the web of textile material. The apparatus includes a rotatable cylinder having looped therearound the web of textile material, the web of printing foil, and a pressing-on or transporting belt. The apparatus furthermore includes a vacuum chamber adapted to be connected to a source of vacuum, and also includes a heating device. The vacuum chamber is defined by a vacuum cap which sealingly engages sections of the cylinder and the pressing-on or transporting belt.

4 Claims, 7 Drawing Figures

DEVICE FOR PRINTING ON WEBS OF TEXTILE MATERIAL

The present invention relates to an apparatus for printing upon textile webs by sublimation of the dye of a printing foil web covering the textile web, which apparatus comprises a cylinder having looped there around a textile web, a printing foil web, and a pressing-on or transporting band, and furthermore comprises a vacuum chamber connectable to a source of a vacuum, and also comprises a heating device.

German Pat. No. 2,005,186 describes a method for printing upon textile webs or sections, according to which the textile web to be treated is passed between an air impervious flexible and heat-resistant transporting belt and a cylinder with an air pervious mantle while the inner chamber of the cylinder within the region covered by the transporting belt is under an underpressure. The heat for the sublimation of the dye of the printing foil is generated by heat radiators, preferably infrared radiators, which are in a ring-like manner arranged around the cylinder. The generation of as high a vacuum as possible with this device is possible only at great expenses concerning the withdrawal of air from the inner chamber of the cylinder or at great expenses with regard to the structural elements for sealing that circumferential part of the cylinder which is not covered by the transporting belt or which represents the boundary region between said section and the section about which the transporting belt is looped.

With a further heretofore known embodiment of an apparatus for printing on textile webs by sublimation of the dye of a printing foil web as described in German Offenlegungsschrift No. 23,321,444, a cylinder with an air pervious mantle is arranged within a large vacuum chamber while the deviating rollers or drums for the textile web, the printing foil web, and a transporting belt are arranged within said vacuum chamber. The cylinder, the lateral walls of which are perforated for feeding atmospheric air into the interior of the cylinder, is arranged in such a way that the cylinder ends are located in the outside air of the vacuum chamber or communicate therewith. The size of the vacuum chamber for receiving the cylinders as well as the devices for guiding the textile web, and an additional transporting belt, as well as the heating device surrounding the cylinder in a ring-like manner, is considerable. The sealing problems are difficult to master.

With devices of the above mentioned general type, not only the consistency of the vacuum but also its magnitude is of decisive importance for the operation of the device, inasmuch as by increasing the vacuum, the working speed of the device and thus the degree of efficiency thereof can be considerably increased. It can be accepted that a decrease in the time in which the dye of the printing foil web acts upon the textile web, corresponds to the same extent to the increase in the vacuum.

German Offenlegungsschrift No. 2,213,559 describes a device for printing upon textile webs with colored patterns, which device includes a drum over which the textile web and the printing foil are brought together, while a heat source is arranged within the drum, and while an endless pressing-on or transporting belt is passed over rollers located laterally of said drum.

It is an object of the present invention to provide an apparatus of the above mentioned general type which will make it possible at relatively low expenses for the structural and operational part to secure a constant, high vacuum.

These and other objects and advantages of the invention will appear more clearly from the following specification in connection with the accompanying drawings, in which.

Figure 1:
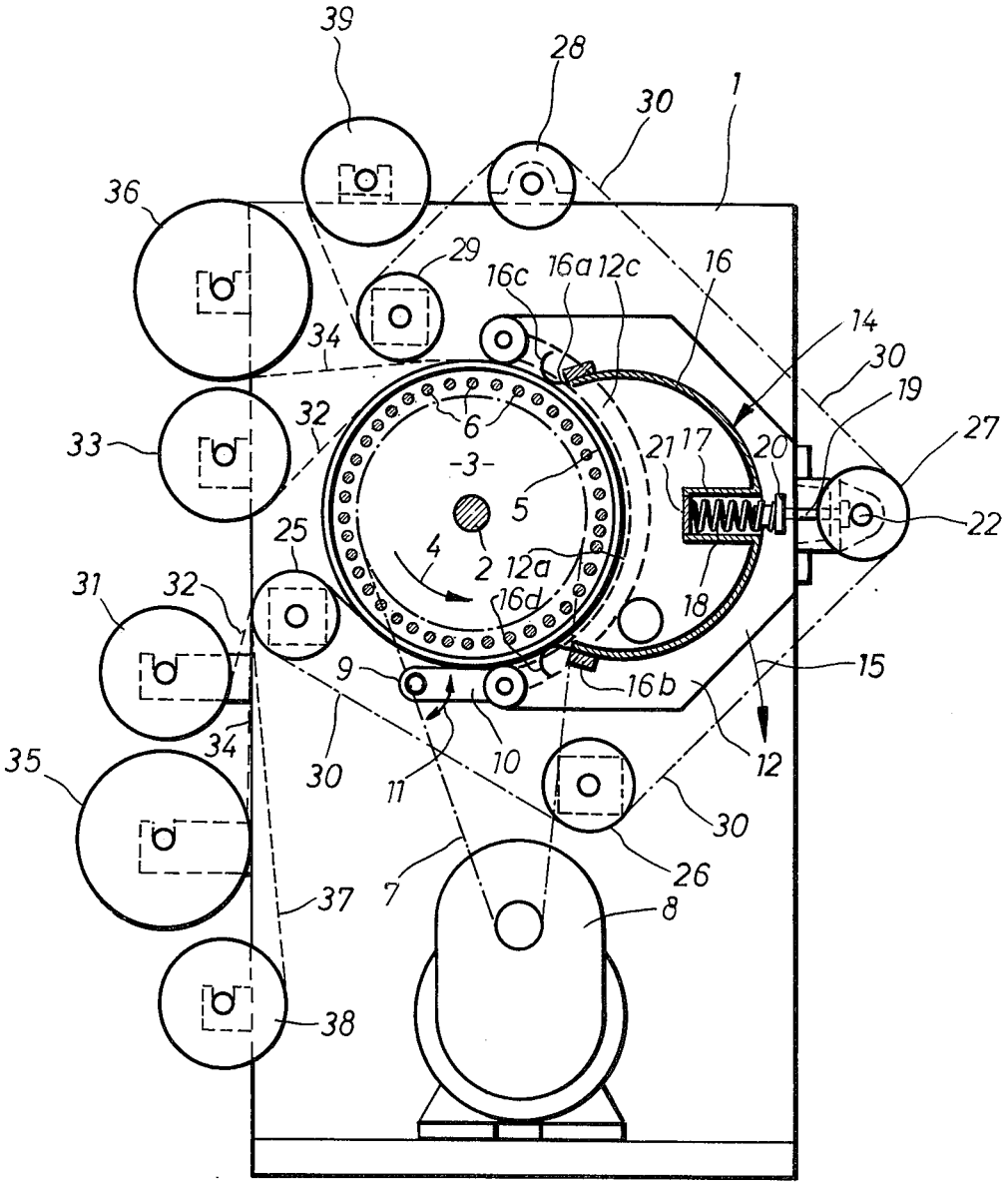
FIG. 1 is a side view of a first embodiment of an apparatus according to the invention.

The apparatus according to the invention is characterized primarily in that the vacuum chamber is formed by a vacuum cap which sealingly engages sections of the cylinder or the presing-on or transporting belt.

The invention is based on the elevator to limit the vacuum seal on the vacuum cap and to reduce the vacuum chamber to a minimum in order to maintain a constant vacuum by a few means only.

According to a further development of the invention, the vacuum cap may be adapted to be adjusted away from the cylinder and on the latter or may be pivotally arranged. In this connection, also the pressing-on or transporting belt with the vacuum cap may be removed from the cylinder, whereby the mounting of a printing foil and of the textile web in the cylinder may be facilitated.

If desired, the transporting belt may advantageously in its central longitudinal section comprise small successive chambers which extend over the belt width or approximately over the belt width.

The vacuum cap may be formed of two parallel self-supporting side walls and a wall arranged therein which has a U-shaped or horse-shoe shaped cross section. The vacuum cap may be under the influence of one or more spring means acting in the direction toward the cylinder axis.

As shown in the drawing, the vacuum cap is wider than the transporting belt and has its lateral sections sealingly engage the two lateral sections of the cylinder, which means that the vacuum cap extends over or approximately over the length of the cylinder, and at its lateral ends projects upon the textile web, the printing foil web, and the transporting belt. The seal of the rim areas of the vacuum cap relative to the transporting belt adjacent thereto and the lateral sections of the cylinder may be effected by elastic diaphragm strips and/or by sheet-shaped spring-like sealing elements.

The cap may also have a hood-shaped form, the marginal portion of which is designed in the form of a rim and comprises sections which extend parallel to the longitudinal axis of the cylinder. Furthermore, between said straight marginal sections on the arched circumference of the cylinder, there may be provided sealing sections following a three-dimensional curve while a sealing bead is inserted into the rim.

Figure 2:
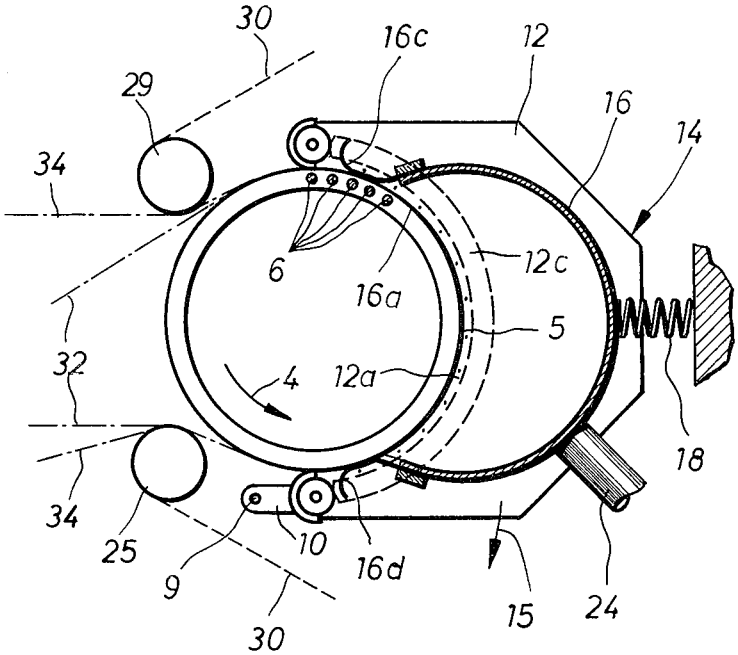
FIG. 2 shows in side view the configuration of the arrangement of the cylinder and the vacuum cap of the embodiment of FIG. 1.
Figure 3:
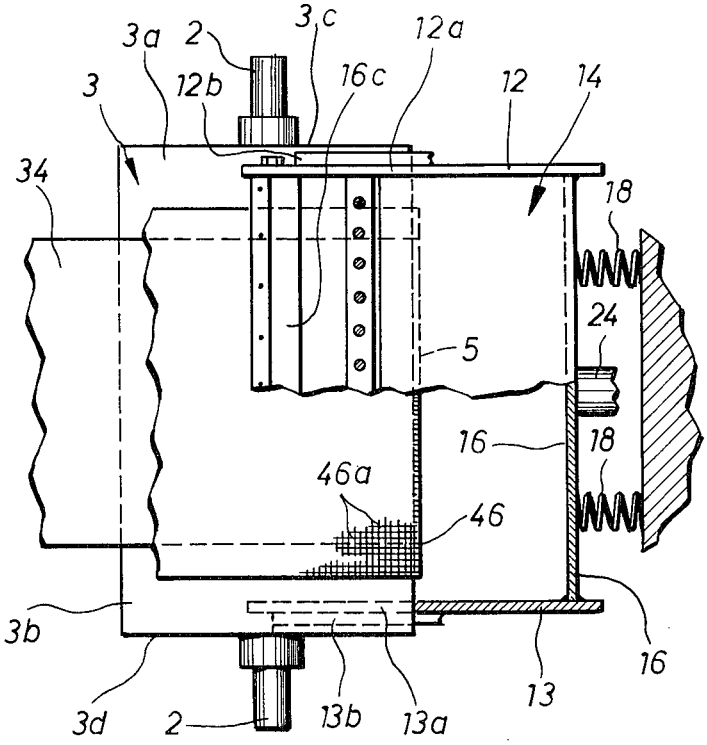
FIG. 3 illustrates in top view the configuration and arrangement of the cylinder and of the vacuum cap of the embodiment of FIG. 1.

Referring now to the drawings in detail, the structure shown in FIGS. 1–3 comprises two horizontal parallel side walls (one side wall 1 only being shown in FIG. 1). At about half the height of said side walls between the same, there is rotatably journalled by means of axle journals 2 a cylinder 3 having its axis arranged horizontally. The cylinder 3 is adapted to rotate with an adjustable speed in the direction of the arrow 4.

The cylinder mantle 5 has a smooth wall and is made of a good heat conductive material so that the heat of the heating device can in the form of heating rods 6 pass to the cylinder surface. Preferably, the heating rods 6 are arranged at the circumference over an angle of 360°, which means over the entire inner side of the cylinder mantle 5 so that a maximum heat radiation onto the cylinder will be effected.

The cylinder 3 may be driven in any desired manner. In the specific example shown, the cylinder 3 is drivingly connected to a driving motor 8 through the intervention of a belt or chain drive 7 and is rotated by said motor 8.

According to the embodiment of the invention illustrated in FIGS. 1–3, the two lateral walls of the apparatus comprise two pivots 9 which face toward each other and about which one link 10 each is pivotable in the direction of the double arrow 11. Each of the links 10 is respectively connected to one of the walls 12, 13 of a vaccum cap 14 which wall is located in the plane of said link and therefore is parallel to the side walls of the apparatus. This connection is such that the walls 12,13, and thus the cap 14 can be pivoted in the direction of the arrow 15 out of the position shown in FIGS. 1 and 2 and can be shifted downwardly.

Between the two walls 12 and 13 of cap 14, there extends a wall 16 which has a U-shaped or horse-shoe shaped cross section and has its lateral rim areas sealingly connected to said wall 12, 13. This wall 16 together with the lateral walls 12, 13 substantially forms the vacuum cap 14.

From the outside of said U- or horse-shoe shaped wall 16 into the interior of the cap 14 there extend two sockets 17 closed in their inner end by a bottom 21 forming one counterbearing for the respective spring 18. The other counterbearing is formed by a dish-shaped member 20 which is connected to a rod 19, and engages a portion of part 22 which may, for instance be in the form of an eccentric and by means of which the rod 19 is adjustable in the longitudinal direction thereof.

By means of the springs 18, the wall 16 and thus the entire vacuum cap 14 is pressed in the direction toward the longitudinal central axis of the vacuum cap and in the direction toward the axis of the cylinder 3 in such a way that the marginal areas 12*a*, 13*a* of walls 12, 13 which marginal areas are adapted to the diameter of the cylinder 3, engage the end sections 3*a*, 3*b* of cylinder 3. Furthermore, the parallel marginal areas 16*a*, 16*b* of wall 16 of the vacuum pump 14 rest against the pressing-on or transporting belt by their sealing means as will be described further below. By adjusting the rod 19, the pressing-on of the hood 14 against the cylinder 3 can be varied. In view of the direction of attack of the springs 18 in the direction toward the axis of the vacuum cap 14 having a horse-shoe shaped cross section and in the direction toward the axis of the cylinder 3, those parts which are arranged at the marginal areas 16*a*, 16*b* of wall 16 as well as at the marginal areas 12*a*, 13*a* of the side walls 12, 13 exert uniform pressures against the cylinder 3 and the pressing-on or transporting belt 30 respectively.

The marginal areas 12*a*, 13*a* of walls 12, 13 are provided with yieldable curved seals 12*b*, 13*b* which are circular in cross section and have a leafspring character. The marginal areas 16*a*, 16*b* of wall 16 of cap 14 comprise the same or similar straight sealing strips 16*c*, 16*d*.

As will be evident from FIG. 3, vacuum conduit 24 leads into the interior of the vacuum cap 14. The vacuum conduit 24 is adapted to be connected to a source of vacuum, for instance a suitable pump.

The cylinder 3 and the vacuum cap 14 are surrounded by a minimum of rolls 25–29 over which is passed an air pervious endless belt 30 forming a pressing-on or transporting belt. On the front side of the apparatus there is provided a winding-off roll 31 from which the printing foil web 32 is wound off and is passed over the deviating roller 25 to the cylinder 3 and finally is passed from the latter to the winding-up roller 33. The printing foil web will thus directly engage the upper surface of the mantle 5 of cylinder 3. The textile web 34 is wound onto a roll 35 and is likewise by means of the deviating roll 25 conveyed to the cylinder 3 while the textile web rests on the printing foil web 32. From the cylinder 3, the textile web 34 is wound onto the winding-up roll 36. Between the endless pressing-on or transporting belt 30 and the textile web 34, still a protective paper web 37 may be introduced which latter is withdrawn from a roll 38 passed over the deviating roll 25 and after being looped around the cylinder 3 is conveyed to the winding-up roll 39. In FIG. 2 this protective paper web has been omitted.

Figure 4:
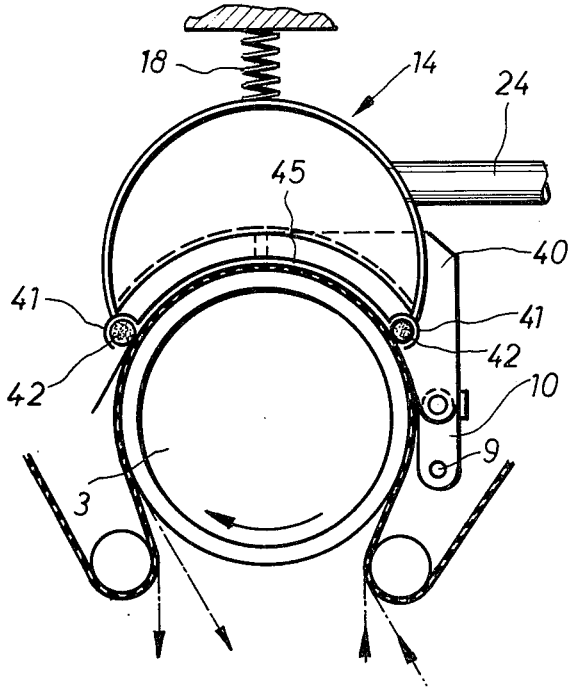
FIG. 4 is a side view of a further embodiment of the invention according to which the cap above the cylinder is adjustable relative to said cylinder while simultaneously taking advantage of the weight of said cap.
Figure 5:
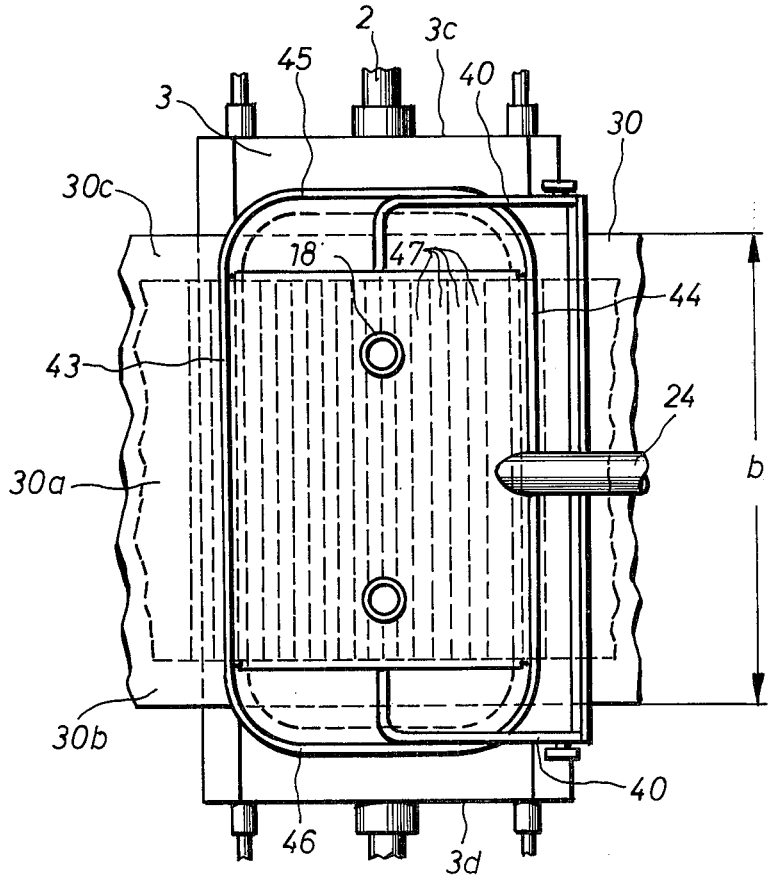
FIG. 5 is a top view of FIG. 4.

While with the embodiment according to FIGS. 1–3, the vacuum cap 14 is horizontally pressed against cylinder 3, according to the embodiment of FIGS. 4 and 5 the cap 14 is so arranged that the effect of the springs 18 by means of which the vacuum cap is sealingly pressed against the cylinder 3 is aided by the weight of the cap 14 and the adjacent portions. Adjacent the cylinder 3 there are again provided two pivots 9 which are directed toward each other, each of which comprises a link 10 having linked thereto an angular part 40. Between the two angular parts 40 there is provided a vacuum cap 14 which is again hood-shaped and has an endless rim margin 41 in which a sealing bead 42 or the like is inserted. The rim margin 41 together with the rim extends over two parallel straight sections 43, 44 and over two curved sections 45, 46 interconnecting said straight sections 43, 44. The straight sections 43, 44 of the sealing bead 42 sealingly engage the intermediate section 30*a* of the pressing-on or transporting belt 30 and more specifically in the same manner as the curved sections 44, 46 outside the end sections 30*b*, 30*c* of belt 3 directly sealingly rest on the cylinder 3.

With all embodiments, the endless belt 30 has a width *b* which is greater than the width of the printing foil web and of the textile web.

As illustrated in FIG. 3, the belt 30 comprises a band 46 with chambers or extensions 46*a*.

As will be evident from FIGS. 3 and 5, the cap 14 with its lateral walls 12, 13 and the sections 45, 46 following a three-dimensional curve extends close to the end faces 3*c*, 3*d* of cylinder 3. In this way, it will be assured that the vacuum cap 14 laterally projects beyond the conveying belt 30, 46 respectively. In this way, it will be assured that the web of goods within the region of the cap is on all sides exposed to a vacuum which means that the top and bottom side and the longitudinal sections of the web of goods are exposed to the vacuum in the cap 14. This is important for the apparatus according to the invention.

As will be seen from the above, the tension of the textile web 34 and of the protective paper 37 on the cylinder 3 the pressing-on or conveying belt 30 to an even greater extent exclusively takes care of the pressure of the textile web onto the printing foil web so that the necessary pressure of both parts at the level of cap 14 will be assured. With the embodiments of FIGS. 6 and 7, the apparatus comprises two lateral side walls 51, 52 between the upper section 51*a*, 52*a* of said side walls 51, 52, there extends a cylindrical hood 53 in horizontal direction the ends 53*a*, 53*b* of which are tightly welded to the walls 51, 52. The wall 51 has a round cover 54 which is concentrically arranged with regard to the hood cross section. The rim 55 of the cover 54 is at the rim of an opening 57 tightly detachably connected to the wall 51. The round opening 57 has a greater diameter than the cylinder 58 but is less than the diameter of the hood 53 so that the cylinder 58 and its inserts can be removed from the hood 53 in longitudinal direction of said hood 53.

Arranged in the wall 52 and in the cover 54 are the sealed bearings for the axle journals 61, 62. Of these axle journals, the journal 62 may be extended in non-illustrated manner and carries the driving wheel for the cylinder 58. Cylinder 58 has its end faces 63, 64 extending up to near the walls 51, 52 and the cover 54 respectively.

Provided in the cylinder 58 are heating elements 65, the energy conductor of which extends outwardly through an axle journal.

Hood 53 surrounds the cylinder 58 over a region of approximately 270°. The diameter of the hood 53 is so selected that between the inner wall of said hood and the cylinder 58 there will be formed a uniform intermediate chamber or space 66 having a thickness of 0.1 to 0.5 meters in which a vacuum will be generated. To this end, this space 66 and the space between the cylinder end face sides 63, 64 and the wall 52 and cover 54 respectively communicate through a conduit 57 with a source of vacuum. That section of hood 53 which in FIG. 7 faces the observer comprises an inlet and outlet opening 68 for the printing foil 69, the textile web 70 and the pressing belt 71, said inlet and outlet opening 68 extending in the longitudinal direction of the hood. Between the belt 71 and the textile web 70 there may also be a protective paper web conveyed if desired. The opening 68 is provided with the parallel rim sections 72, 73 and the rim sections 74, 75 connected to the rim sections 72, 73. The total opening rim formed by the rim sections 72–75 comprises an endless rim 76 which opens toward the cylinder 58 and has a tubular cross section. A likewise endless compressible air inflated sealing hose or thick sealing cord 77 which has a round or polygonal cross section is inserted into said endless rim 76.

The printing foil 69 and the textile web 70 are wound up on rolls 78–81 in a manner similar to that set forth above in connection with the description of FIGS. 1–5. The endless pressure belt 71 is conveyed over rolls 82–86. This belt 71 has a width which is slightly less than the straight marginal sections 72, 73 so that the sealing hose of the thick compressible sealing cord 77 will tightly rest on the parallel region of said sealing cord 77 and also on the adjacent regions outside the belt 71 on the end sections of cylinder 58.

Figure 6:
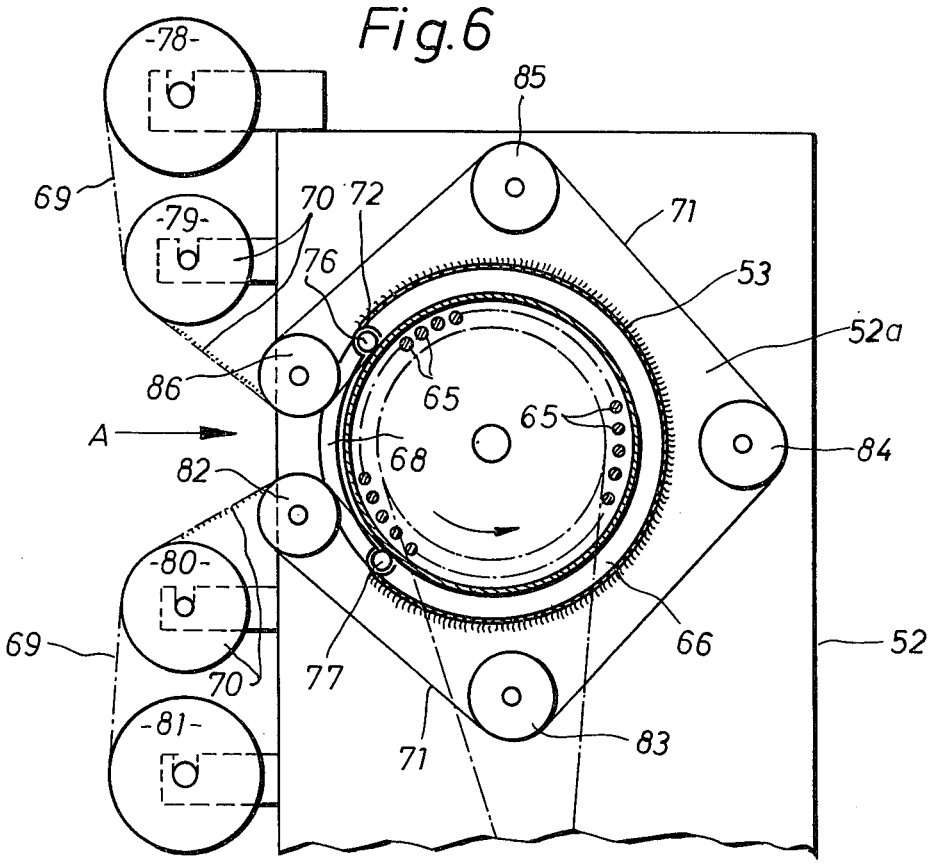
FIG. 6 shows in side view a further embodiment of the device according to the invention.
Figure 7:
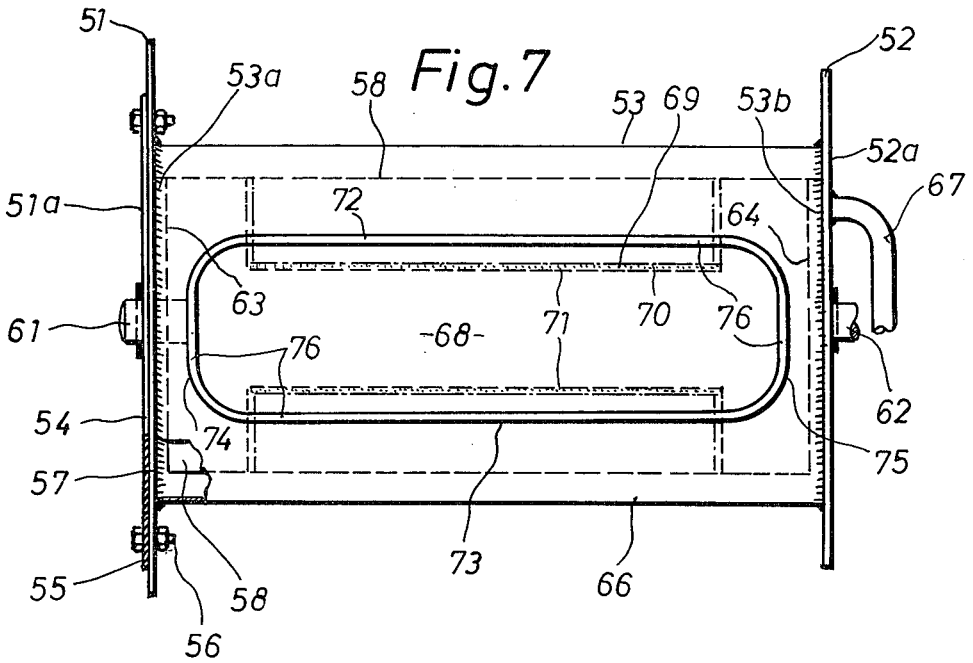
FIG. 7 illustrates a view of FIG. 6 as shown in the direction of the arrow A.

Also with the embodiment of FIGS. 6 and 7, the cylinder 58 is surrounded by hood 53 which forms a small, very well controllable vacuum chamber. All rolls for the webs and belts are located outside said chamber or space. The printing foil and the textile web are looped around the cylinder 58 by an angle of more than 270° and over this angle are exposed to the heat of the cylinder 58 and to the vacuum in hood 53, while said printing foil and textile web are exposed to the vacuum with a minimum volume.

It is, of course, to be understood that the present invention is, by no means, limited to the specific showing in the drawings, but also comprises any modifications within the scope of the appended claims.

What we claim is:

1. In a combination with an apparatus for printing upon webs of textile material by sublimation of the dye of printing foil web, which includes a rotatable cylinder having an axis, means for looping a web of textile material and of a printing foil web and a belt around said cylinder, a heating device in said cylinder, a tubular wall surrounding the cylinder in spaced relationship and with side walls forming a chamber around the cylinder and being connected with a vacuum source and provided with inlet and outlet means for the textile material, the foil web and the belt, one side wall of said vacuum chamber being formed as by welding, the other side wall being detachably connected in an airtight manner to the tubular wall, and an endless compressible sealing means surrounding the inlet and outlet means.

2. An apparatus in combination according to claim 1 in which one of said side walls includes an opening coaxial with and larger than the said cylinder.

3. An apparatus in combination according to claim 2, wherein a cover plate tightly seals the opening.

4. An apparatus in combination according to claim 3, wherein bearings for the axis of the cylinder are supported by one of the side walls and the cover plate respectively.

* * * * *